US008201659B2

(12) United States Patent
Imai et al.

(10) Patent No.: US 8,201,659 B2
(45) Date of Patent: Jun. 19, 2012

(54) RECOILLESS SPEAKER SYSTEM

(75) Inventors: Kazumichi Imai, Osaka (JP); Yasue Imai, Osaka (JP)

(73) Assignee: Kazumichi Imai (JP)

( * ) Notice: Subject to any disclaimer, the term of this patent is extended or adjusted under 35 U.S.C. 154(b) by 0 days.

(21) Appl. No.: 12/738,819

(22) PCT Filed: Apr. 21, 2008

(86) PCT No.: PCT/JP2008/057676

§ 371 (c)(1),
(2), (4) Date: Aug. 11, 2010

(87) PCT Pub. No.: WO2009/050908

PCT Pub. Date: Apr. 23, 2009

(65) Prior Publication Data

US 2010/0294588 A1 Nov. 25, 2010

(30) Foreign Application Priority Data

Oct. 19, 2007 (JP) ..... 2007-272950

(51) Int. Cl.
*H04R 1/02* (2006.01)

(52) U.S. Cl. ..... 181/146; 181/144; 181/151

(58) Field of Classification Search ..... 181/144, 181/146, 148, 151, 155, 199, 207, 208; 381/335, 381/338, 353, 354
See application file for complete search history.

(56) References Cited

U.S. PATENT DOCUMENTS 3,393,764 A * 7/1968 Schafer ..... 381/89
3,978,941 A * 9/1976 Siebert ..... 181/151
4,268,719 A * 5/1981 Manger ..... 381/89
5,191,177 A * 3/1993 Chi ..... 181/153
5,583,324 A * 12/1996 Thomasen ..... 181/199
6,079,515 A * 6/2000 Newman ..... 181/156
6,141,428 A * 10/2000 Narus ..... 381/338
6,279,679 B1 * 8/2001 Thomasen ..... 181/208
6,678,384 B2 * 1/2004 Kowaki et al. ..... 381/182
6,796,401 B2 * 9/2004 Yoshii et al. ..... 181/166

(Continued)

FOREIGN PATENT DOCUMENTS

CN 1279877 A 1/2001

(Continued)

OTHER PUBLICATIONS

Wikipedia Page for Glass Wool, accessed Jul. 22, 2011.*

(Continued)

*Primary Examiner* — Jeremy Luks
(74) *Attorney, Agent, or Firm* — Cantor Colburn LLP

(57) ABSTRACT

The present invention provides a recoilless speaker system capable of reducing adversely affecting vibration and generating an accurate and strong sound, and contributing to the realization of lighter weight, miniaturization and lower cost related to manufacturing, and also capable of being installed in a suspended state and generating sound even under zero gravity as long as air exists.

The present invention includes a symmetrical and tubular resonance wall and a pair of or two or more pairs of vibration units symmetrically arranged on both left and right sides of the resonance wall, where the vibration units that form a pair are configured to vibrate synchronously with each other, the resonance wall is made from a flexible material so as to resonate to the vibration, a sound absorbing member is arranged in a tubular form along the inner wall of the resonance wall, and vibration suppressing materials are held at the sound absorbing member and/or the vibration unit.

12 Claims, 7 Drawing Sheets

U.S. PATENT DOCUMENTS

| | | | | |
|---|---|---|---|---|
| 7,270,215 | B2 * | 9/2007 | Stiles | 181/151 |
| 2002/0017982 | A1 | 2/2002 | Nishiyama et al. | |
| 2002/0136423 | A1 | 9/2002 | Fukuda | |
| 2004/0017920 | A1 * | 1/2004 | Nishikawa et al. | 381/89 |
| 2004/0208336 | A1 * | 10/2004 | Hamada | 381/386 |
| 2007/0092096 | A1 | 4/2007 | Litovsky | |
| 2007/0158134 | A1 * | 7/2007 | Fryette | 181/199 |

FOREIGN PATENT DOCUMENTS

| | | | |
|---|---|---|---|
| CN | 1329456 | A | 1/2002 |
| EP | 1061767 | A1 | 12/2000 |
| EP | 1162864 | A2 | 12/2001 |
| GB | 2222745 | A | 3/1990 |
| JP | 4-58698 | A | 2/1992 |
| JP | 8-307979 | A | 11/1996 |
| JP | 10-84594 | A | 3/1998 |
| JP | 2000-32578 | A | 1/2000 |
| JP | 2001-352593 | A | 12/2001 |
| JP | 2349752 | A1 | 12/2001 |
| JP | 2003-158786 | A | 5/2003 |
| WO | 99/26450 | A1 | 5/1999 |

OTHER PUBLICATIONS

International Search Report for PCT/JP2008/057676 mailed Jun. 17, 2008 with English translation.

European Search Report for European Application No. 08 74 0718 dated Oct. 27, 2010.

* cited by examiner

RECOILLESS SPEAKER SYSTEM

CROSS REFERENCE TO RELATED APPLICATIONS

This is a U.S. national stage application of International Application No. PCT/JP2008/057676, filed on 21 Apr. 2008. Priority under 35 U.S.C. §119(a) and 35 U.S.C. §365(b) is claimed from Japanese Application No. JP2007-272950, filed 19 Oct. 2007, the disclosure of which is also incorporated herein by reference.

TECHNICAL FIELD

The present invention relates to a recoilless speaker system used alone or by being incorporated in a television receiver, an audio equipment, and the like.

BACKGROUND ART

Although originally a speaker unit that forms sound by generating wave in the air, the energy for forming sound cannot be effectively converted to sound in the existing speaker unit. In other words, about half of the energy is converted to vibration of the unit itself without becoming a sound thereby causing distortion of sound and dull vibration, and inhibiting an accurate sound formation, which is the object of the unit.

In a speaker system in which the speaker unit is incorporated in an enclosure (speaker box), the enclosure itself similarly vibrates by the vibration of the speaker unit, and such vibration is transmitted to the floor. Generally, the sound becomes difficult to accurately reproduce as the sound becomes lower unless the enclosure is securely fixed to the floor. Thus, if a low sound is emitted at large volume, the entire room may shake by the generated vibration, and the vibration may be transmitted to the adjacent room.

DISCLOSURE OF THE INVENTION

Problems to be Solved by the Invention

In order to solve the various problems described above, each manufacturing company has devoted energy to retrieving only the necessary sound (vibration) from the speaker unit and suppressing other vibrations. Most of the currently circulating speaker systems have become heavier and harder in an aim of reducing the vibration that lowers the sound quality by the weight of the speaker unit or the enclosure and the hardness of the raw material thereof.

In such speaker system, however, not only are the above-described problems basically unresolved, but the manufacturing cost needlessly increases due to increase in weight (and enlargement involved therewith) and hardness.

In a normal speaker unit, the sound is formed by moving a cone and shaking the air, where a magnet, a frame, and the like move in the opposite direction by counteraction thereby generating vibration that inhibits the sound. Therefore, an ideal speaker unit is configured such that the cone, which becomes the direct generation source of sound, moves with satisfactory response, and the generation of wasteful vibration from the magnet that exerts power on the cone, the frame for holding the magnet, the enclosure, and the like is suppressed.

The inventors of the invention contrived arranging a speaker unit including two cones 3 of the same shape that perform the same movement in opposite directions with a reference line ∞ in between, as shown in FIG. 7 and FIG. 8.

With such configuration, the air on both sides of the cones 3 become a wave (sound), and the generation of wasteful vibration from the speaker unit is assumed to be suppressed since a symmetrical vibration having the reference line ∞ as an axis applies on the speaker unit including the cones. Therefore, the vibration that inhibits the generation of an accurate sound is barely generated in the speaker unit itself, and the majority of the energy is efficiently converted to sound by the cones 3, and thus an accurate and strong sound of low distortion can be ultimately generated. In FIG. 7 and FIG. 8, 6 is the magnet, 7 is the voice coil bobbin, and 8 is the voice coil.

The present invention has been contrived in view of the above matters, and it is an object to provide a recoilless speaker system capable of reducing adversely affecting vibration and generating an accurate and strong sound, and contributing to the realization of lighter weight, miniaturization and lower cost related to manufacturing, and also capable of being installed in a suspended state and generating sound even under zero gravity as long as air exists.

Means for Solving the Problems

To achieve the above aim, a recoilless speaker system of the present invention includes a symmetrical and tubular resonance wall and a pair of or two or more pairs of vibration units symmetrically arranged on both left and right sides of the resonance wall, where the vibration units that form a pair are configured to vibrate synchronously with each other, the resonance wall is made from a flexible material so as to resonate to the vibration, a sound absorbing member is arranged in a tubular form along the inner wall of the resonance wall, and vibration suppressing materials are held at the sound absorbing member and/or the vibration unit (claim 1).

More specifically, the recoilless speaker system of the present invention includes a symmetrical and tubular resonance wall and a pair of or two or more pairs of vibration plates and a pair of or two or more pairs of vibration generation units symmetrically arranged on both left and right sides of the resonance wall, where the vibration plates that form a pair are configured to vibrate synchronously with each other by the vibration applied from the vibration generation units, the resonance wall is made from a flexible material so as to resonate to the vibration, a sound absorbing member is arranged in a tubular form along the inner wall of the resonance wall, and vibration suppressing materials are held at the sound absorbing member and/or the vibration generation unit (claim 2).

In the recoilless speaker system, the vibration suppressing material may be arranged diagonally with respect to the resonance wall (claim 3), or a reinforcement body may be arranged at the resonance wall (claim 4).

Effect of the Invention

In the inventions according to claims 1 to 4, there is obtained a recoilless speaker system capable of reducing adversely affecting vibration and generating an accurate and strong sound, and contributing to the realization of lighter weight, miniaturization and lower cost related to manufacturing, and also capable of being installed in a suspended state and generating sound even under zero gravity as long as air exists.

In the inventions according to claims 1, 2, recoilless can be realized while suppressing the generation of wasteful vibration by causing the pair of vibration units or vibration plates to generate symmetrical vibration, and only the necessary vibration (sound) is transmitted to the outside, and thus adversely affecting vibration (noise) can be reduced and an accurate and strong sound can be generated, and larger volume than that obtained when two vibration units or two vibration plates are simply used is obtained.

In the inventions according to claims 1, 2, a speaker that can realize lighter weight, miniaturization, and lower cost related to manufacturing, and furthermore, that can be installed in a suspended state and generate sound even under zero gravity as long as air exists can be obtained since the speaker system does not need to be made heavier and harder to reduce the wasteful vibration.

In the inventions according to claims 1, 2, the resonance wall resonates to the vibration of the vibration unit or the vibration plate, and the so-called sound box (as called in the field of audio) can be used to a maximum extent similar to most musical instruments such as violin and double bass, and hence high quality sound (sound true on the input signal) can be generated at sufficient volume even if the unit itself is small.

In the inventions according to claims 1, 2, the sound quality can be further improved since the wasteful vibration is not generated, and such wasteful vibration is not transmitted to the resonance wall, the enclosure, the floor, and the like.

In the inventions according to claims 1, 2, the occurrence of standing wave in the tubular body can be reliably suppressed by holding the vibration suppressing material at the sound absorbing member, the vibration unit, or the vibration generation unit.

In the invention according to claim 3, the effect of suppressing the occurrence of standing wave can be enhanced by diagonally arranging the vibration suppressing material held at the sound absorbing material.

In the invention according to claim 4, the action such as tuning acts to greatly prevent wasteful vibration by arranging a reinforcement body, and the effect of improving sound quality is significantly enhanced.

BRIEF DESCRIPTION OF THE DRAWINGS

FIG. 4(A) is a front view, FIG. 4(B) is a side view, FIG. 4(C) is a plan view, and FIG. 4(D) is a bottom view.

| DESCRIPTION OF SYMBOLS | |
|---|---|
| 1 | resonance wall |
| 2 | vibration unit |
| 4 | vibration generation unit |
| 9 | reinforcement body |
| 11 | cover body |
| K | sound absorbing member |
| S | vibration suppressing material |
| T | vibration suppressing material |

BEST MODE FOR CARRYING OUT THE INVENTION

Figure 1:
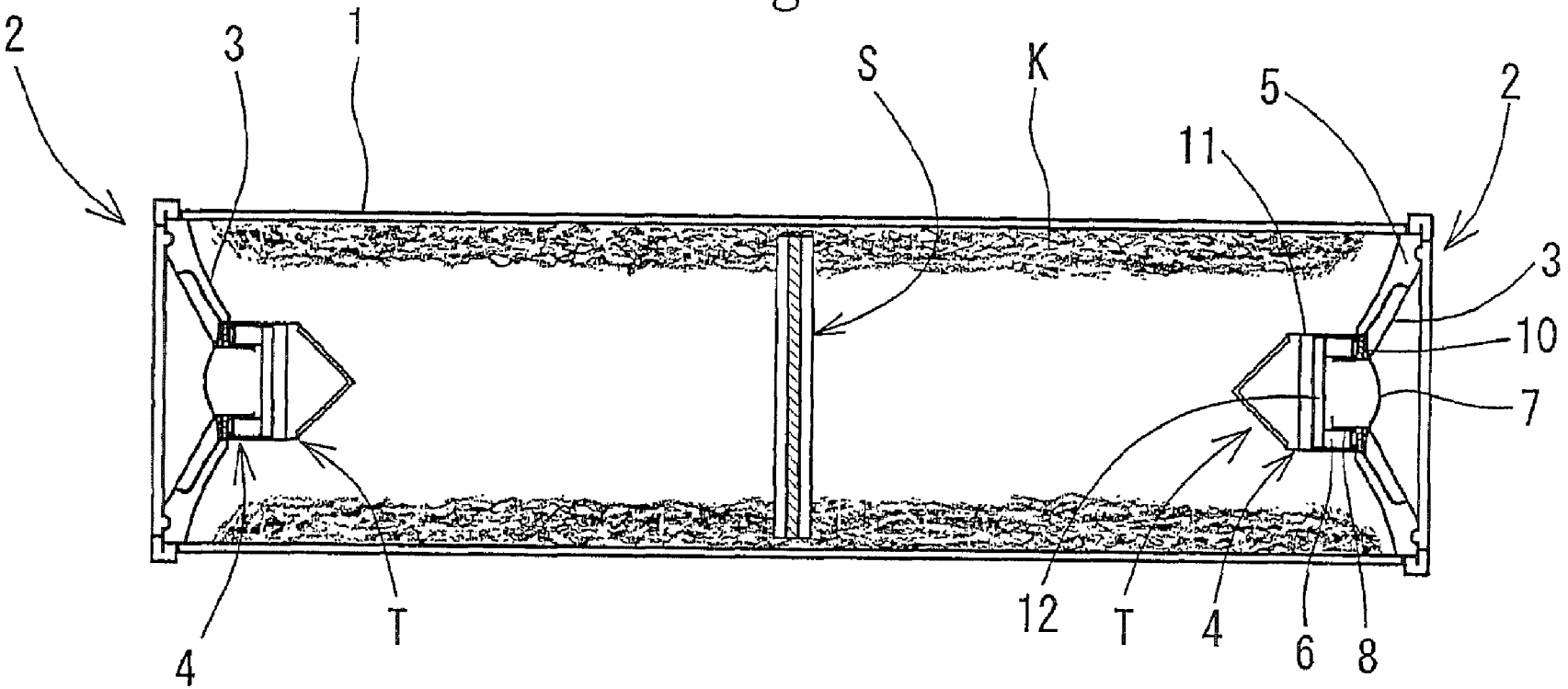
FIG. 1 is a longitudinal cross-sectional view schematically showing a configuration of a recoilless speaker system according to one embodiment of the present invention.

Embodiments of the present invention will be described with reference to the drawings. FIG. 1 is a longitudinal cross-sectional view schematically showing a configuration of a recoilless speaker system according to one embodiment of the present invention.

As shown in FIG. 1, the recoilless speaker system of the present embodiment includes a symmetrical and tubular (cylindrical in the illustrated example) resonance wall 1, and a pair of vibration units 2 symmetrically arranged on both left and right sides of the resonance wall 1, where the vibration units 2 that form a pair vibrate synchronously with each other, and the resonance wall 1 is made from a flexible material so as to resonate to the vibration.

The flexible material forming the resonance wall 1 may be natural resin processed on wood (wood plate), paper etc., metal such as aluminum, and the like, other than synthetic resin such as polypropylene and polyethylene terephtalate.

The vibration unit 2 is configured by a pair of vibration plates (cones) 3 and a pair of vibration generation units 4 symmetrically arranged on both left and right sides of the resonance wall 1. The vibration generation unit 4 includes a frame 5 fixed to the resonance wall 1, a substantially cylindrical magnet 6 fixed to the frame 5, a voice coil bobbin 7 that slides on the inner side of the frame 5 and is fixed to the vibration plate 3, and a voice coil 8 wounded to the voice coil bobbin 7. The two voice coils 8 arranged in the pair of vibration generation units 4 are wounded to the voice coil bobbins 7 so as to be wounded opposite to each other.

In FIG. 1, 10 is a damper for supporting the sliding voice coil bobbin 7, and 11 is a cover body that covers a metal supporting body 12 for supporting the magnet 6 and the magnet 6.

As shown in FIG. 1, the recoilless speaker system has a flexible fibrous or porous sound absorbing material K arranged in a tubular form along the inner wall of the resonance wall 1, and vibration suppressing materials S, T held by the sound absorbing material K and the vibration unit 2 (cover body 11 of the vibration generation unit 4 in the present embodiment).

Glass wool, felt, sponge, and the like may be used for the sound absorbing material K.

Figure 2A:
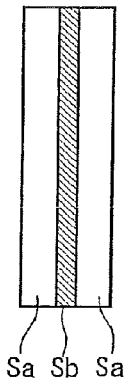
FIG. 2(A) is a longitudinal cross-sectional view schematically showing a configuration of a vibration suppressing material held at a sound absorbing member shown in FIG. 1, and FIG. 2 (B) to (E) are longitudinal cross-sectional view schematically showing a configuration of a variant of the vibration suppressing material.

As shown in FIG. 2(A), the vibration suppressing material S to be held by the sound absorbing material K is a member in which a butyl rubber body Sb, serving as a member for giving mass to the substantially circular plate shaped vibration suppressing material S and for absorbing the vibration of air, is concentrically arranged between two substantially circular plate shaped felt bodies Sa, serving as a member for absorbing the vibration of air, to provide air permeability. As shown in FIG. 1, the edges of the vibration suppressing material S are held by the sound absorbing material K. The holding method may be merely locking the edges of the vibration suppressing material S to the sound absorbing material K, or may be appropriately adhering using adhesive, and the like. In either holding method, the vibration suppressing material S is desirably held so as to freely move to a certain extent in the front and back direction and in the up and down, left and right directions in the resonance wall 1.

Figure 2B:
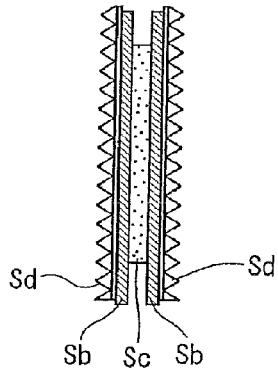
Figure 2C:
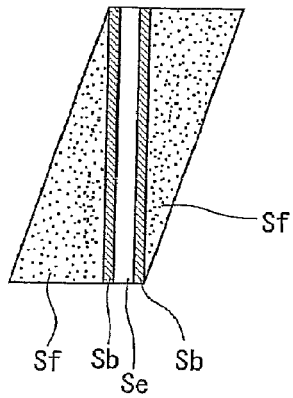
Figure 2D:
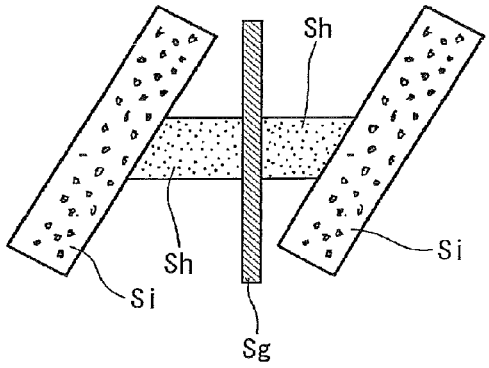
Figure 2E:
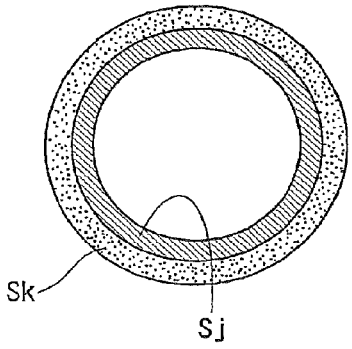
Figure 3:
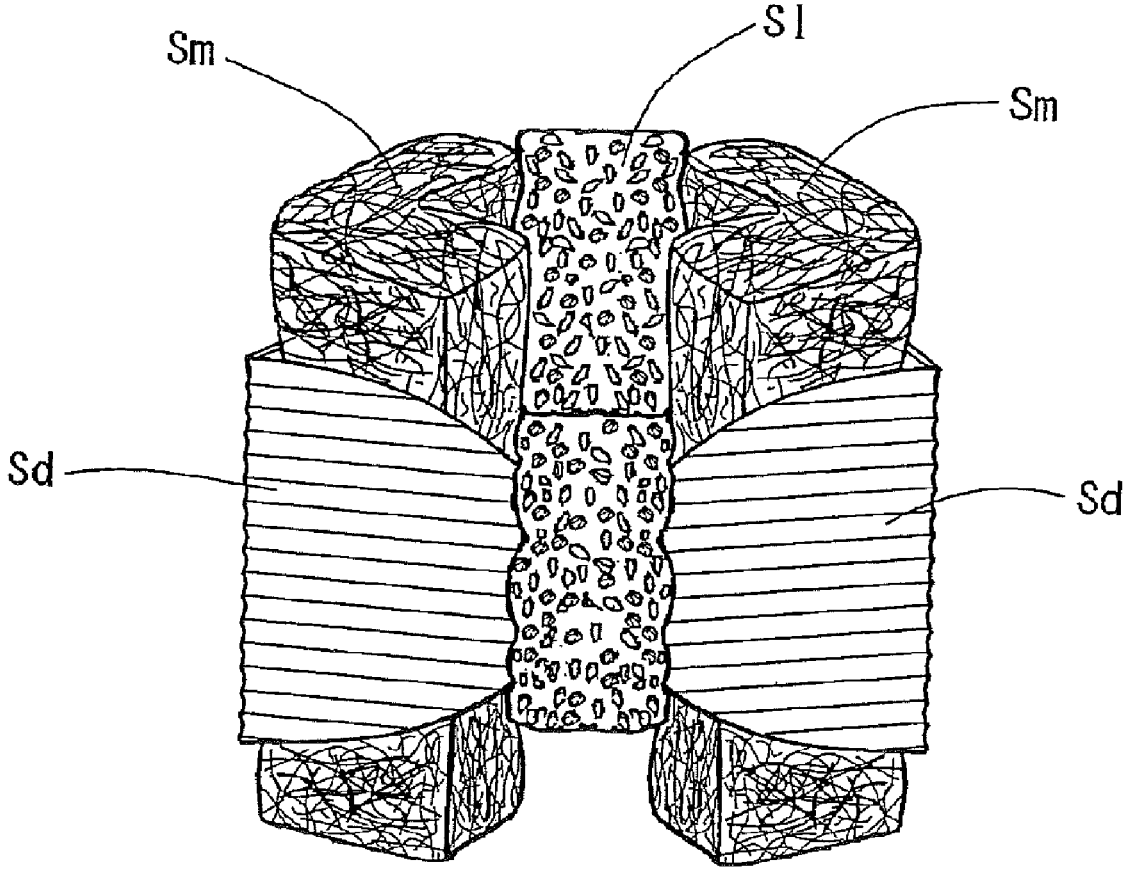
FIG. 3 is a perspective view schematically showing a configuration of another variant of the vibration suppressing material.
Figure 4A:
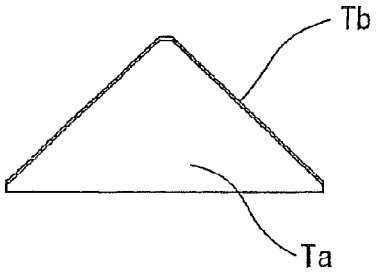
FIGS. 4(A)-4(D) are diagrams schematically showing the configuration of the vibration suppressing material held at the vibration unit shown in FIG. 1, where
Figure 4B:
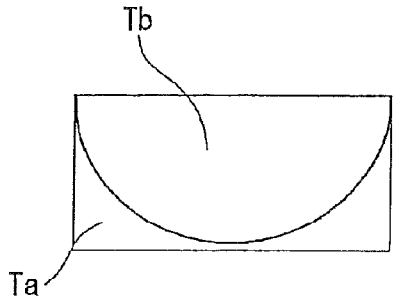
Figure 4C:
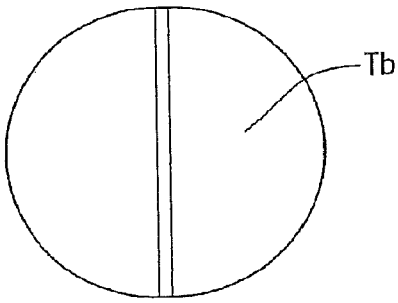
Figure 4D:
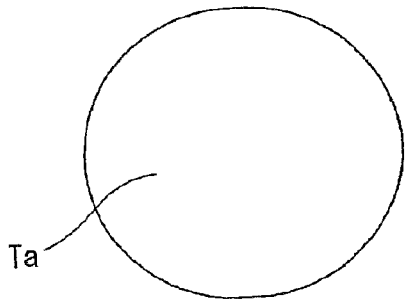

The vibration suppressing material S is not limited to the above configuration, and may be configured by a substantially circular plate shaped sponge body Sc, serving as a member for absorbing the vibration of air, two butyl rubber bodies Sb, and two substantially circular plate shaped bent paper bodies Sd, serving as a member having a surface for scattering/diffusing the vibration of air, as shown in FIG. 2(B); may be configured by a substantially circular plate shaped plywood plate Se serving as a core material, two butyl rubber bodies Sb, and two sponge bodies Sf, serving as a member for absorbing the vibration of air, presenting a shape in which a circular column is diagonally divided to half, as shown in FIG. 2(C); may be configured by a substantially circular plate shaped FRP body Sg, serving as a supporting body, for giving mass to the vibration suppressing material S, two high repulsive sponge bodies Sh, serving as a member for absorbing the vibration of air, that present a shape in which the distal end of the circular column is diagonally cut, and two substantially circular plate shaped low repulsive sponge bodies Si, serving as a member having a surface for absorbing the vibration of air and for scattering/diffusing the vibration of air, as shown in FIG. 2(D); may be configured by arranging a sponge body Sk, serving as a member for absorbing the vibration of air on the outer side of a hollow and substantially spherical butyl rubber body Sj, serving as a member for giving mass to the vibration suppressing material S and for absorbing/reflecting/diffusing the vibration of air, as shown in FIG. 2(E); or may be configured by a substantially rectangular solid shaped sponge body Sl, serving as a member that is porous and formed with a great number of holes covered by a film and holes not covered with a film and having a surface for absorbing the vibration of air and scattering/diffusing the vibration of air, two glass wools Sm that is longer in the up and down direction than the sponge body Sl and its transverse cross-sectional shape is substantially V-shape, serving as a member for absorbing the vibration of air, and two bent paper bodies Sd bent to half, serving as a member having two surfaces for scattering/diffusing the vibration of air, as shown in FIG. 3.

Various configurations thus can be adopted for the vibration suppressing material S, where the shape and the material thereof can be appropriately selected and combined for use, and in particular, configuration by a complex member combining a plurality of members made of raw materials different from each other is desired, and foam aluminum and the like serving as a member for giving mass to the vibration suppressing material S and for absorbing/reflecting/diffusing/scattering the vibration of air can be used for the raw material other than the above-described raw materials. A method of combining each member and integrating as a complex member may adopt various methods such as adhering with adhesive, suturing, and the like. The vibration suppressing material S is a member that suppresses the vibration energy of the air in the resonance wall 1 (suppress the vibration energy from becoming large) by one of own vibration, and reflection, scattering, diffusion, and absorption of wave of the air, and the vibration suppressing material S is not desirably configured with only a light-weight sponge body.

Furthermore, as shown in FIG. 1, the vibration suppressing material S may be arranged at substantially the middle of the resonance wall 1 or may be arranged at other positions avoiding the middle. An example in which the vibration suppressing material S is made substantially perpendicular to the resonance wall 1 is shown in FIG. 1, but the vibration suppressing material S may be obliquely arranged with respect to the resonance wall 1.

In each example shown in FIG. 1 and FIG. 2(A) to 2(E), the vibration suppressing material S has a substantially circular shape in side view, but this is not the sole case, and may have a substantially rectangular shape in side view, for example.

As shown in FIG. 1, and FIG. 4(A) to (D), the vibration suppressing material T held by the vibration unit 2 includes a foam polystyrene body Ta, serving as a member having a surface for absorbing the vibration of air and for scattering/diffusing the vibration of air, presenting a shape in which the distal end of the circular column is diagonally cut to become tapered, and a substantially two-fold circular plate shaped felt body Tb serving as a member for absorbing the vibration of air, and the foam polystyrene body Ta and the felt body Tb are adhered with adhesive to have the vibration suppressing material T held by the cover body 11 of the vibration unit 2. The holding method of the vibration suppressing material T may use various methods such as appropriately locking the vibration suppressing material T to the cover body 11.

The vibration suppressing material T is not limited to the above configuration, and can adopt various configurations and can adopt various configurations of the vibration suppressing material S. The vibration suppressing material T may be held at the site other than the cover body 11 in the vibration unit 2.

In the recoilless speaker system configured as above, current similarly flows to the two voice coils 8. Since the directions the two voice coils 8 are wounded are opposite to each other, the vibration plates 3 forming a pair vibrate synchronously (in symmetry) with each other by the vibration applied from the vibration generation unit 4. Thus, the wasteful vibrations generated by the vibration of the pair of vibration units 2 cancel each other out near the middle of the resonance wall 1, and only the necessary (sound) is transmitted to the outside, and hence the adversely affecting vibration (noise) can be reduced and an accurate and strong sound can be generated in the recoilless speaker system, and a larger volume can be obtained than when the vibration unit 2 is simply divided to half.

In the recoilless speaker system, lighter weight, miniaturization, and lower cost related to manufacturing cost can be realized since the speaker system does not need to be made heavier and harder to reduce the wasteful vibration.

Furthermore, in the recoilless speaker system, the resonance wall 1 resonates to the vibration of the vibration unit 2, and the so-called sound box (as called in the field of audio) can be used to a maximum extent similar to most musical instruments such as violin and double bass, and hence high quality sound (sound true on the input signal) can be generated at sufficient volume even if the unit itself is small.

The speaker having directivity in both directions as in an announcement speaker installed at the platform of a station can be easily manufactured using the speaker system, which speaker has satisfactory sound transmission and such function can be exhibited satisfactorily.

In the recoilless speaker system, the flexible and porous sound absorbing member K is arranged in a tubular form along the inner wall of the resonance wall 1, the vibration suppressing material S is held at the sound absorbing member K, and the vibration suppressing material T is also held at the vibration unit 2, and thus the countermeasures on the vibration caused by the speaker system itself and the countermeasures on the standing wave caused by the wave of the air in the resonance wall 1 formed by the speaker system can be simultaneously carried out.

In the above-described embodiment, the vibration suppressing materials S, T are arranged, but only one may be arranged.

Figure 5:
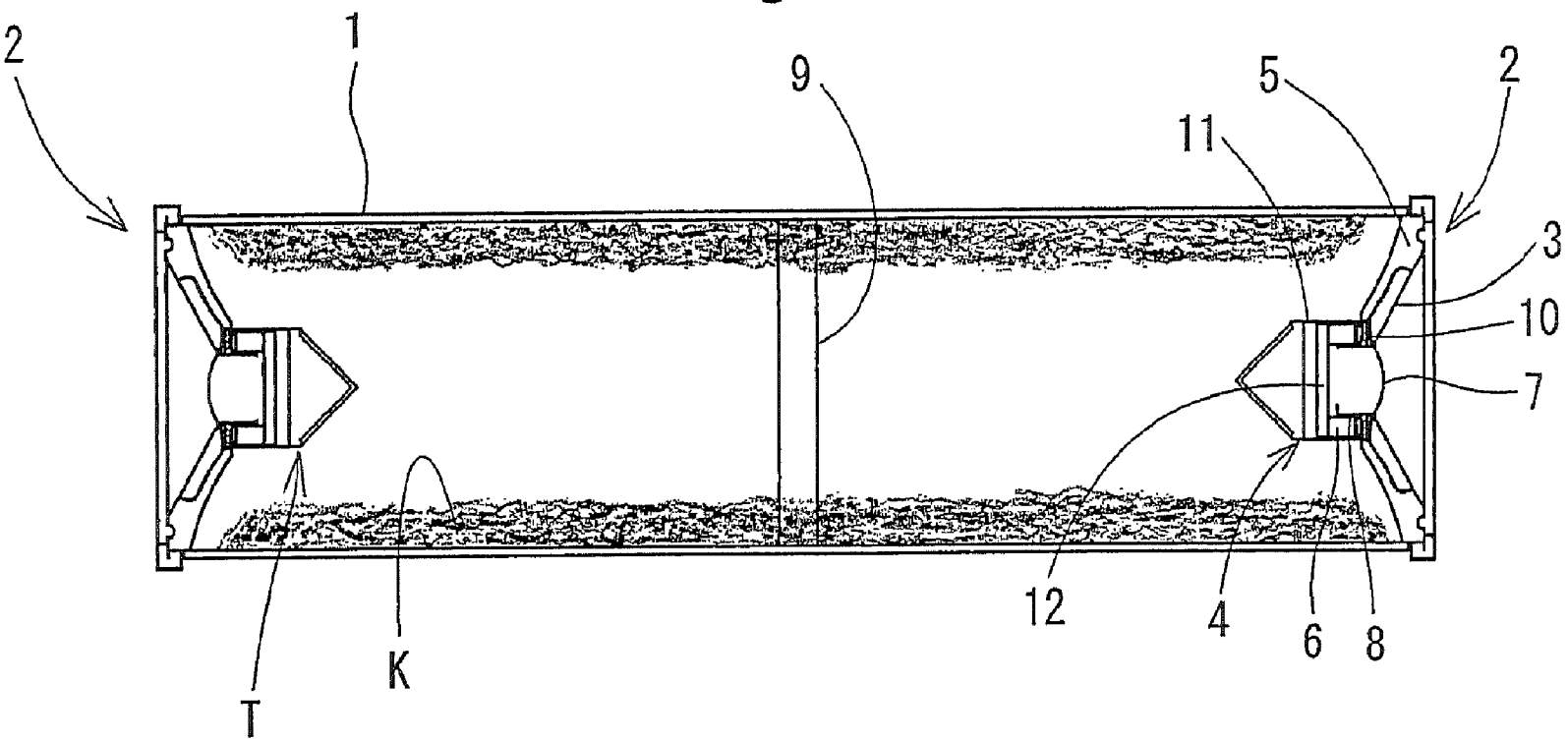
FIG. 5 is a longitudinal cross-sectional view schematically showing a configuration in which a reinforcement body is arranged in the recoilless speaker system.

As shown in FIG. 5, a reinforcement body 9 may be arranged at the central part of the resonance wall 1. The reinforcement body 9 is made of a circular plate body that lies along the inner side of the resonance wall 1, and can be formed from polyethylene plate, styrol plate, and the like. The reinforcement body 9 is positioned at equal distance from the pair of vibration units 2, and the reinforcement body 9 barely vibrates even if the pair of vibration units 2 are in the vibration state since the relevant position is the position where the vibrations generated by the pair of vibration units 2 cancel each other. However, the position of arranging the reinforcement body 9 is not limited to the central part of the resonance wall 1, and may be a position shifted from the central part. The illustration of the vibration suppressing material S is omitted in FIG. 5, but the vibration suppressing material S may be arranged, in which case, the vibration suppressing material S is held at the sound absorbing member K at the position shifted from the central part of the resonance wall 1 so that the vibration suppressing material S does not overlap with the reinforcement body 9.

When the reinforcement body 9 is arranged as mentioned above, the vibration generated from the vibration unit 2 is not transmitted to the enclosure, the floor, and the like, and the sound quality can be further improved by adopting a configuration of supporting the reinforcement body 9 and the vicinity thereof with the enclosure and the like. From such standpoints, an appropriate suspension member may be coupled and locked at the reinforcement body 9 or the vicinity thereof so that the recoilless speaker system can be suitably used while being suspended from the roof, etc., and the recoilless speaker system can be made lighter, whereby use in such mode is not limited to a special facility and can be sufficiently realized even in general households, and the like, and use can also be made even in a special situation such as zero gravity as long as air exists.

With the arrangement of the reinforcement body 9, the action such as tuning acts to greatly prevent wasteful vibration, and the effect of improving sound quality is significantly enhanced.

Figure 6:
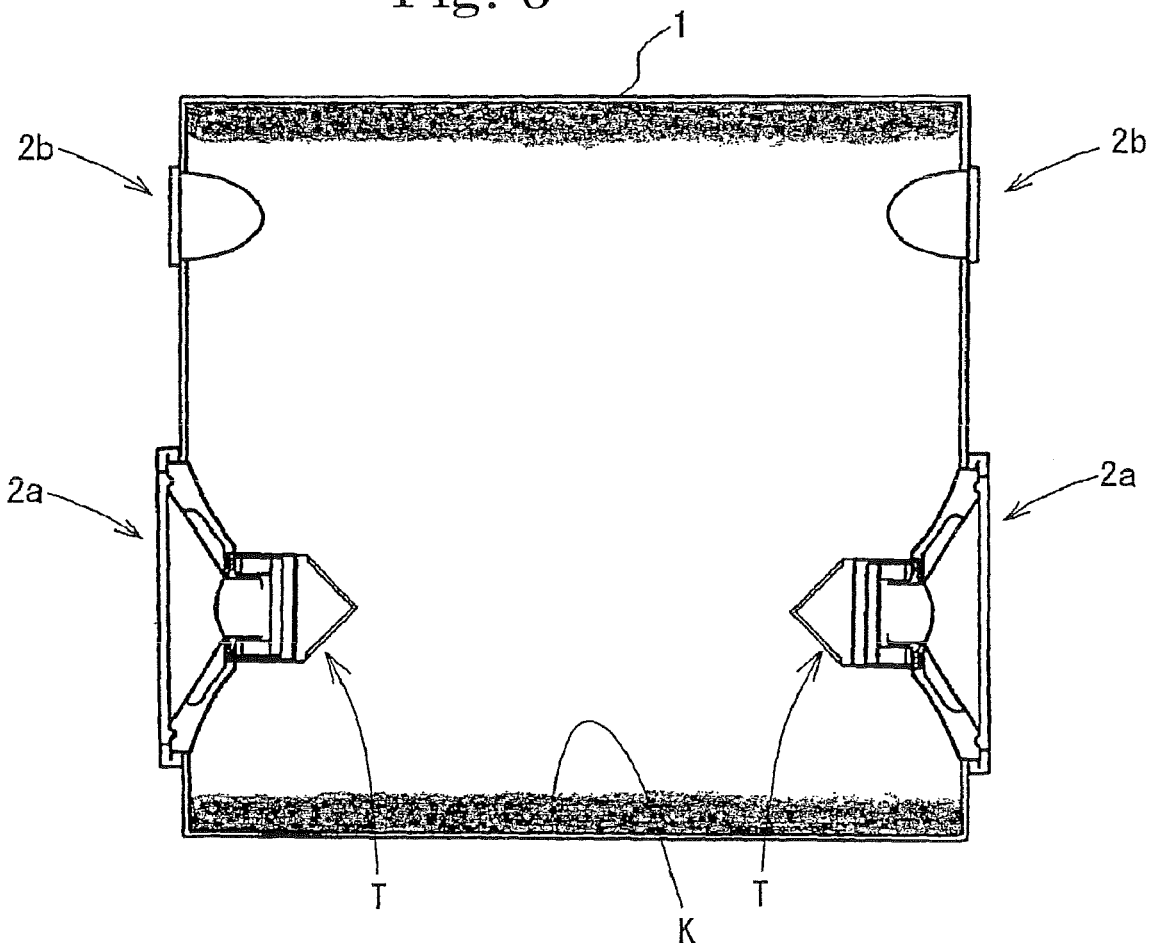
FIG. 6 is a longitudinal cross-sectional view schematically showing a configuration in which two pairs of vibration units are arranged in the recoilless speaker system.
Figure 7:
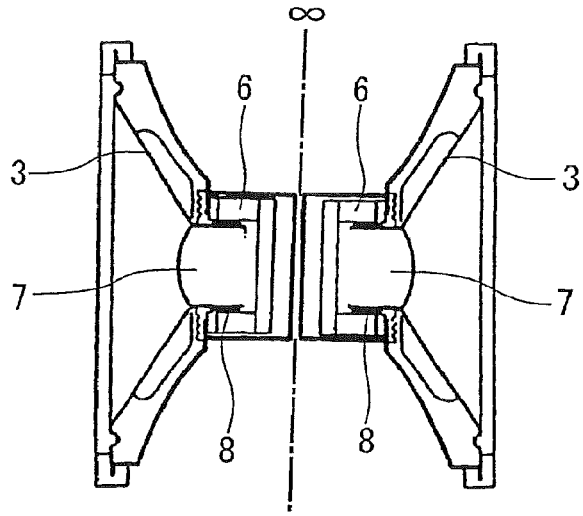
FIG. 7 is an explanatory view schematically showing a configuration that becomes the basis of the present invention.
Figure 8:
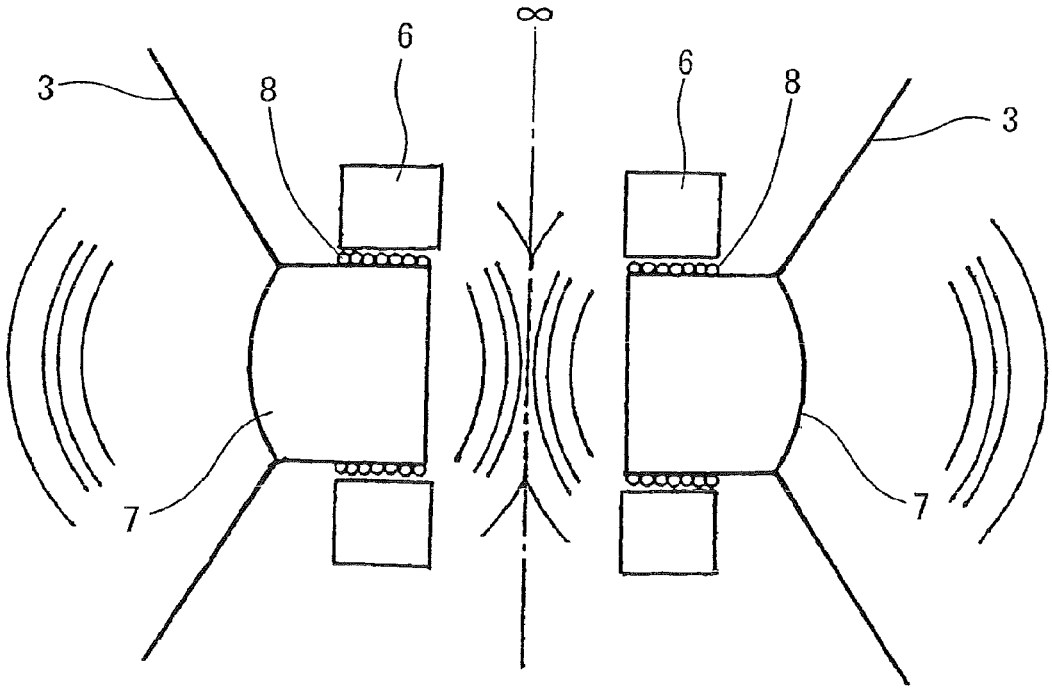
FIG. 8 is an explanatory view schematically showing the main parts of the configuration that becomes the basis of the present invention.

FIG. 1 and FIG. 5 show an example in which a pair of vibration units 2 is arranged, but two pairs of vibration units 2 (2*a*, 2*a* and 2*b*, 2*b*) may be arranged as shown in FIG. 6, or three or more pairs may be arranged (not shown). In any case, the configuration of the pair of opposite vibration units 2 merely needs to be symmetric, and plural pairs of vibration units 2 of different types can be arranged. FIG. 6 shows an example in which a low sound speaker (woofer) 2*a* and a high sound speaker (tweeter) 2*b* are arranged and the illustration of the vibration suppressing material S is omitted, but the vibration suppressing material S may be arranged and held at the sound absorbing member K.

The vibration units 2 that form a pair may not necessarily generate the vibration energy that becomes the same with respect to each other when the same signal is flowed, and one vibration unit 2 may be a woofer of large vibration energy and the other vibration unit 2 may be a full-range of small vibration energy. In such a case, wasteful vibration slightly occurs, but the occurrence of wasteful vibration can be prevented compared to when arranging only one of the vibration units 2.

In FIG. 1, FIG. 5, and FIG. 6, the resonance wall 1 is not limited to a cylindrical shape, and may be a square tubular shape, and the like.

Furthermore, in FIG. 1, FIG. 5, and FIG. 6, the vibration unit 2 is not limited to the illustration, and the existing or known ones may be used.

INDUSTRIAL APPLICATION

The recoilless speaker system according to the present invention can be used while being suspended from the roof, and the like, and can also be made lighter, and thus use in such mode is not limited in a special facility and can be sufficiently realized even in general households, and the like, and use can also be made even in a special situation such as zero gravity as long as air exists. The speaker unit without the enclosure can be applied to an actuator.

What is claimed is:

1. A recoilless speaker system comprising:

a symmetrical and tubular resonance wall; and a pair of or two or more pairs of vibration units symmetrically arranged on both left and right sides of the resonance wall, wherein the vibration units that form a pair are configured to vibrate synchronously with each other, the resonance wall is made from a flexible material so as to resonate to the vibration, a sound absorbing member is arranged in a tubular form along the inner wall of the resonance wall, vibration suppressing materials are held by the sound absorbing member, the vibration suppressing materials are disposed between the vibration units and provided distant from the vibration units; and the vibration suppressing materials are held by the sound absorbing member so as to be movable in each of three dimensions.

2. The recoilless speaker system according to claim 1, wherein the vibration suppressing material held at the sound absorbing member is arranged diagonally with respect to the resonance wall.

3. The recoilless speaker system according to claim 1, wherein a reinforcement body is arranged at the resonance wall.

4. The recoilless speaker system according to claim 2, wherein a reinforcement body is arranged at the resonance wall.

5. The recoilless speaker system according to claim 1, wherein second vibration suppressing materials are held by the vibration generation units, the second vibration suppressing materials being different from the vibration suppressing materials held by the sound absorbing member.

6. The recoilless speaker system according to claim 1, wherein the vibration suppressing materials are configured by a complex member combining a plurality of members made of materials different from each other.

7. A recoilless speaker system comprising:

a symmetrical and tubular resonance wall; and a pair of or two or more pairs of vibration plates and a pair of or two or more pairs of vibration generation units symmetrically arranged on both left and right sides of the resonance wall, wherein the vibration plates that form a pair are configured to vibrate synchronously with each other by the vibration applied from the vibration generation units, the resonance wall is made from a flexible material so as to resonate to the vibration, a sound absorbing member is arranged in a tubular form along the inner wall of the resonance wall, vibration suppressing materials are held by the sound absorbing member, the vibration suppressing materials are disposed between the vibration units and provided distant from the vibration units;

the vibration suppressing materials are held by the sound absorbing member so as to be movable in each of three dimensions.

8. The recoilless speaker system according to claim 7, wherein the vibration suppressing material held at the sound absorbing member is arranged diagonally with respect to the resonance wall.

9. The recoilless speaker system according to claim 7, wherein a reinforcement body is arranged at the resonance wall.

10. The recoilless speaker system according to claim 8, wherein a reinforcement body is arranged at the resonance wall.

11. The recoilless speaker system according to claim 7, wherein second vibration suppressing materials are held by the vibration generation units, the second vibration suppressing materials being different from the vibration suppressing materials held by the sound absorbing member.

12. The recoilless speaker system according to claim 7, wherein the vibration suppressing materials are configured by a complex member combining a plurality of members made of materials different from each other.

* * * * *